US006872230B2

(12) United States Patent
Cross et al.

(10) Patent No.: US 6,872,230 B2
(45) Date of Patent: Mar. 29, 2005

(54) LUBRICITY ADDITIVES FOR LOW SULFUR HYDROCARBON FUELS

(75) Inventors: Collin W. Cross, Houston, TX (US); Zen-Yu Chang, Hockessin, DE (US); S. Blake Pruett, Montgomery, TX (US); Alan E. Goliaszewski, Woodlands, TX (US)

(73) Assignee: Betzdearborn, Inc., Trevose, PA (US)

( * ) Notice: Subject to any disclaimer, the term of this patent is extended or adjusted under 35 U.S.C. 154(b) by 72 days.

(21) Appl. No.: 10/197,307

(22) Filed: Jul. 16, 2002

(65) Prior Publication Data

US 2004/0010963 A1 Jan. 22, 2004

(51) Int. Cl.[7] ..... C10L 1/18; C10L 1/22

(52) U.S. Cl. ..... 44/417; 44/335; 44/432; 44/433

(58) Field of Search ..... 44/335, 417, 432, 44/433

(56) References Cited

U.S. PATENT DOCUMENTS

| | | | | |
|---|---|---|---|---|
| 2,991,162 A | | 7/1961 | Malec | |
| 3,615,294 A | | 10/1971 | Von Allmen | |
| 3,677,726 A | | 7/1972 | Coran et al. | |
| 3,762,889 A | | 10/1973 | Newman et al. | |
| 3,785,789 A | * | 1/1974 | Honnen et al. | 44/417 |
| 3,951,614 A | * | 4/1976 | Honnen et al. | 44/331 |
| 4,125,383 A | * | 11/1978 | Holtz | 44/372 |
| 4,416,669 A | * | 11/1983 | Graiff et al. | 44/417 |
| 4,666,529 A | | 5/1987 | Graiff | |
| 4,789,493 A | | 12/1988 | Horodysky | |
| 4,808,196 A | | 2/1989 | Horodysky | |
| 5,492,641 A | | 2/1996 | Mohr et al. | |

FOREIGN PATENT DOCUMENTS

| | | |
|---|---|---|
| EP | 0 568 873 B1 | 11/1993 |
| FR | 2.079.593 | 11/1971 |
| GB | 1526357 | 9/1978 |

* cited by examiner

*Primary Examiner*—Cephia D. Toomer
(74) *Attorney, Agent, or Firm*—Hoffmann & Baron, LLP

(57) ABSTRACT

The present invention relates to additives for enhancing the lubricity of hydrocarbon fuel oils, the inventive additive composition including one or more of the reaction products of (i) an alkylated polyamine and (ii) urea or isocyanate, or the salt adducts of these reaction products. More particularly, the present invention provides for a process for improving the lubricity of hydrocarbon fuel oils, which are low in inherent lubricity due to treatment to reduce sulfur and aromatic components for improved emissions.

39 Claims, No Drawings

LUBRICITY ADDITIVES FOR LOW SULFUR HYDROCARBON FUELS

FIELD OF THE INVENTION

The present invention provides for hydrocarbon fuel oil compositions, which have as a component an additive for improving the lubricity of the fuel oil and reducing engine system wear. In particular, this invention provides for the use of the reaction products of (i) an alkylated polyamine and (ii) urea or isocyanate, or the salt adducts of these reaction products, as additives for improving the lubricity of distillate fuels, which are low in inherent lubricity due to treatment to reduce the sulfur and/or aromatic content.

BACKGROUND OF THE INVENTION

Regulatory agencies have mandated a reduction in the sulfur, aromatic, and hetero-atom content of commercial diesel and distillate fuels in an effort to improve emissions characteristics of the fuels. This regulatory requirement causes a problem insofar as the fuel industry recognizes that the refining processes needed to produce these fuels require a more severe hydrotreatment which removes polar species from the fuel and reduces its lubricity. Reducing the level of one or more of the sulfur, polynuclear aromatic or polar components of diesel fuel oil can reduce the ability of the oil to lubricate the injection system of the engine, causing the fuel injection pump of the engine to fail prematurely. Even marginally lower lubricity can significantly increase wear of fuel pumps, valves and injector nozzles over an extended period of use.

The problem of poor lubricity in these fuels is likely to be exacerbated by future engine system developments aimed at further decreasing emissions. This will result in an increase in the fuel oil lubricity requirement relative to requirements for present engines. For example, the use of high pressure unit injectors will likely increase the need for better fuel oil lubricity.

For the reasons above, there has been an ever-growing effort to produce additives, which can improve the lubricity of fuels low in sulfur and/or aromatics. For example, dimertrimer acids are sold commercially as lubricity additives. Moreover, commercially available tall oil fatty acids are used as lubricity improvers for low sulfur and/or aromatic fuels. A problem associated with additives based on acids is their tendency to cause gel formation in the fuel filter, due to an incompatibility with other lube oil additives into which they may come into contact. For this reason, some fuel producers specify non-acidic chemistries to avoid these problems.

To avoid the problems associated with acid groups, a number of lubricity improvers are available commercially which have been produced by reacting the acid to form an amide or ester. For example, U.S. Pat. Nos. 4,789,493 and 4,808,196 to Horodysky describe N-alkylalkylenediamine amides and their use as friction reducing additives in lubricants. As described, these additives are preferably made by reacting an N-alkylalkylenediamine with a carboxylic acid. One problem associated with such amide additives is that the reactions used for their formation can be reversed, causing a regeneration of the acid which leads to the same gellation problem in fuel filters encountered as when acidic lubricity improvers are added. In addition, these additives have a tendency to cyclize over time.

U.S. Pat. No. 5,492,641 and EP 0568873 B1 to Mohr disclose the use of Beta-aminonitriles, and/or N-alkylpropylenediamines obtained by hydrogenating these Beta-aminonitriles, as detergents and dispersants in gasoline fuels. It further discloses that these compounds may be used as lubricant additives for gasoline fuels.

U.S. Pat. No. 3,677,726 describes the use of monosubstituted ureas as varnish-removing fuel additives for hydrocarbon fuel compositions. It is known that fuel oils are prone to form gum during periods of prolonged storage that result in formation of resin-like deposits on equipment, such as fuel lines and filters that can be problematic. The additives are disclosed as being effective in removing lacquer and varnish deposits attributable to gum after they have formed.

U.S. Pat. No. 3,615,294 to Von Allmen and U.S. Pat. No. 3,762,889 to Newman et al. each describe a gasoline fuel composition containing a carburetor detergent additive comprised of the neutral salt reaction product of a substituted urea and a paraffinic oil oxidate. The substituted urea can be formed from the reaction between commercial Duomeen (N-alkyldiaminopropane) and urea. The paraffin oil oxidate, as known in the art, corresponds to a large and poorly defined group of various types of chemical functionalities that are formed when oxidizing a base lubricating oil. This reference does not disclose the use of either the salt adduct of the substituted urea or the substituted urea itself as lubricity enhancers, nor does it disclose the use of either of these compounds in fuels outside those consisting of a mixture of hydrocarbons in the gasoline boiling range (i.e. from about 75° C. to 450° C.).

As described above, the poly-aromatic content of a fuel has dramatic effects on the lubricity of a fuel. Since gasoline and diesel have very different amounts of aromatic content, it would be expected that the effects of an additive would behave differently for each of these fuels. In addition, lubricity is generally not a problem in a gasoline-based engine because the fuel pump is lubricated by crankcase oil. In this situation, the lubriciousness of the fuel is not an issue when considering fuel pump wear. For a diesel engine, however, the situation is quite different. In these engines, the lubrication of the fuel pump is accomplished by the diesel fuel itself.

There is a growing need in the fuel industry for stable, non-acidic compounds which can serve as lubricity improvers for fuels treated to be low in sulfur and/or aromatic components, particularly given the increasing pressure from regulatory agencies to produce such fuels worldwide. In particular, there is a need for lubricity additives for low sulfur diesel fuels.

SUMMARY OF THE INVENTION

The present invention provides a hydrocarbon fuel oil composition comprising: (a) a hydrocarbon fuel oil; and (b) one or more cyclic or open chain urea derivatives formed from an alkylene polyamine.

The invention further provides a hydrocarbon fuel oil composition including a hydrocarbon fuel oil; and a lubricity additive that includes one or more of the reaction products of (i) an alkylated polyamine and (ii) urea or isocyanate, or the salt adducts of these reaction products.

Also provided is a hydrocarbon fuel oil composition that includes a hydrocarbon fuel oil having a sulfur content of about 0.01 to about 0.5% by weight per weight of the hydrocarbon fuel; and a lubricity additive including the reaction products of (i) an alkylated polyamine and (ii) urea or isocyanate, or the salt adducts of these reaction products.

A reaction between (i) an alkylated polyamine and (ii) urea or isocyanate produces a mixture of reaction products including the compounds of Formulae I, II, and III, which form the basis of the lubricity additive compositions of the present invention and the inventive fuel oil compositions that include them.

Compounds according to Formulae I, II and III are shown below.

Formula I

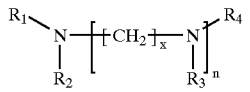

Formula II

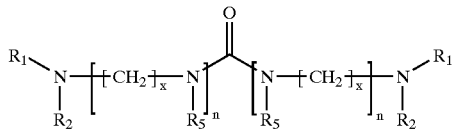

Formula III

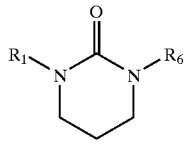

For each of the formulae above, the substituents are defined as follows: $R_1$ is a hydrocarbyl group from $C_{8-30}$; $R_2$ is each independently hydrogen, a hydrocarbyl group from $C_{8-30}$, or the group Y; $R_3$ is each independently hydrogen, a hydrocarbyl group from $C_{8-30}$, or $(CH_2)_qOH$; $R_4$ is hydrogen, a hydrocarbyl group from $C_{8-30}$, $(CH_2)_qOH$, or the group Y; $R_5$ is each independently hydrogen, a hydrocarbyl group from $C_{8-30}$, or $(CH_2)_qOH$; $R_6$ is hydrogen, or a hydrocarbyl group from $C_{8-30}$; x is from 2–6 and n is from 1 to 6, or mixtures thereof; q is from 1 to 6; and Y is as follows, wherein $R_3$ is as defined above.

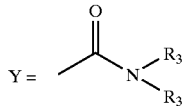

The invention provides an additive composition for increasing the lubricity of a hydrocarbon fuel oil that includes one or more cyclic or open chain urea derivatives formed from an alkylene polyamine.

Another aspect of the invention relates to an additive composition for increasing the lubricity of a hydrocarbon fuel oil, the additive composition including a reaction product of (i) an alkylated polyamine and (ii) urea or isocyanate, or a salt adduct of the reaction product, where the reaction product includes a compound of Formula I.

A further aspect of the invention is directed to an inventive lubricity additive composition that includes a mixture of compounds according to Formula I and Formula II, or the salt adducts of the mixture.

Further provided by the invention is a method of making an additive composition for enhancing the lubricity of a hydrocarbon fuel oil, the method including reacting (i) an alkylated polyamine and (ii) urea or isocyanate under conditions to form a compound of Formula I.

A further aspect of the invention relates to a process for improving the lubricity of a hydrocarbon fuel oil, where the process includes combining the fuel oil with a sufficient amount of one or more of the reaction products of (i) an alkylated polyamine and (ii) urea or isocyanate, or the salt adducts of these reaction products.

DETAILED WRITTEN DESCRIPTION

It has now been found that certain additive compositions are capable of improving the lubricity of fuel oils low in inherent lubricity due to hydrotreating to remove undesirable sulfur and/or aromatic components. The inventive additive compositions include one or more cyclic or open chain urea derivatives formed from an alkylene polyamine. Open chain urea derivatives include compounds having Formula I or II. Cyclic urea derivatives include the compounds of Formula III. In one embodiment of the invention, the alkylene polyamine is N-alkyldiaminopropane. A reaction between (i) an alkylated polyamine and (ii) urea or isocyanate produces a mixture of reaction products including the compounds of Formulae I, II, and III which form the basis for the lubricity additives useful as components of the hydrocarbon fuel oil compositions of this invention. The subsequent addition of a low molecular weight carboxylic acid forms the salt adducts of the mixture, which provide another basis for useful lubricity additives according to the present invention.

For example, one of the products of the reaction between (i) an alkylated polyamine and (ii) urea or isocyanate is a substituted urea according to Formula II below. Since the substituted urea is weakly basic, it can form salts with various acids. In particular, the substituted urea may undergo an acid-base reaction in the presence of an acid such as a low molecular weight carboxylic acid to form a salt. In one embodiment, one or more of the products of the reaction between (i) an alkylated polyamine and (ii) urea or isocyanate reacts with propionic acid to form the salt adduct or adducts.

In one embodiment, the lubricity additive includes a compound according to Formula I below, or a salt thereof:

Formula I

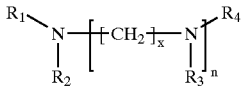

In a further embodiment, the lubricity additive includes the compound of Formula II below, or a salt thereof:

Formula II

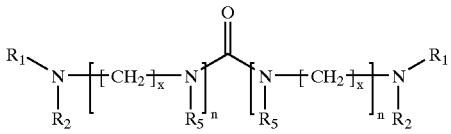

In yet another embodiment, the lubricity additive includes a compound of Formula III below, or a salt thereof:

Formula III

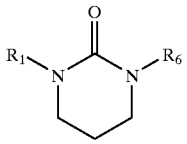

For each of the Formulae above, and throughout the entire specification, including claims, the substituents are defined as follows:

$R_1$ is a hydrocarbyl group from $C_{8-30}$; $R_2$ is each independently hydrogen, a hydrocarbyl group from $C_{8-30}$, or the group Y; $R_3$ is each independently hydrogen, a hydrocarbyl group from $C_{8-30}$, or $(CH_2)_qOH$; $R_4$ is hydrogen, a hydrocarbyl group from $C_{8-30}$, $(CH_2)_qOH$, or the group Y; $R_5$ is each independently hydrogen, a hydrocarbyl group from $C_{8-30}$, or $(CH_2)_qOH$; $R_6$ is hydrogen, or a hydrocarbyl group from $C_{8-30}$; x is from 2–6 and n is from 1 to 6, or mixtures thereof; q is from 1 to 6; and Y is as follows, wherein $R_3$ is as defined above.

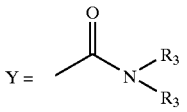

In one embodiment of this invention, the lubricity additive includes a mixture of the compounds of Formulae I, II, and III or salt adducts of the mixture. In one desired embodiment, the ratio of the compound of Formula I to the compound of Formula II in this mixture is about 1:1 to about 4:1. In another preferred embodiment, the ratio of the compound of Formula I to the compound of Formula II in the mixture is about 1.5:1 to about 2.5:1. In a further embodiment, the preferred ratio of the compound of Formula III to the combined mixture of compounds of Formula I and II is about 0:1 to about 2.5:1.

The lubricity additive of the invention preferably includes a predominant amount of a mixture of the compounds of Formulae I and II, or salt adducts of the mixture. For purposes of the present invention, by the term predominant it is meant that the mixture of compounds is present in greater amounts relative to other components which may be present. It is noted that one or another of the products of the reaction between (i) an alkylated polyamine and (ii) urea or isocyanate, or their salt adducts, may be enriched relative to the other reaction products.

As indicated above, the lubricity additives useful for this invention find particular application in low sulfur fuel oils. The fuel oil preferably has a sulfur concentration of 0.2 percent by weight or less based on the weight of the fuel, and desirably 0.05 percent or less. Such fuels may be made by methods known in the fuel-producing art including solvent extraction, hydrodesulfurization and sulfuric acid treatment. While these fuels may be hydrocarbon fuels, oxygenates or mixtures of hydrocarbon fuels and oxygenates may also be useful for this invention. The hydrocarbon fractions which may be used for the fuel compositions include distillate fuels which boil in the kerosene and gas oil range (165° C. to 560° C.). Typical middle distillate fuels of this type would include road diesel and other diesel fuels which have boiling ranges of about 200–307° C., as well as jet fuels, kerosenes, gas oil and cycle oils. These middle distillate fuels can include straight run distillate oils, catalytically or thermally cracked distillate fuel oils, as well as mixtures of straight run distillate fuel oils with cracked distillate stocks. Normally, these fuels are derived from petroleum, however they may also be derived, at least in part, from other sources including shale, tar sands, coal, lignite, biomass and similar sources. Moreover, the fuels may include oxygenate blending components such as alcohols or ethers. It is within the contemplation of the present invention that the fuels may also wholly comprise oxygenates such as ethanol and/or methanol. Furthermore, the fuels of the compositions of the present invention may also be those which have been subjected to conventional treatment processes including treatment with acid or base, hydrogenation, solvent refining or clay treatment.

While the fuel compositions of the present invention may be used in jet engines, gas turbines, or diesel engines, in a desired embodiment of the invention the fuel is one which is suitable for use in a diesel engine. Diesel fuels can vary widely in composition depending on the nature of the crude oil, the refining process, the components with which the raw fuel is blended, as well as other factors. The use of this invention as noted above finds a particularly desired application in diesel fuels which have a reduced sulfur and/or aromatic content which are now being produced worldwide in order to comply with the requirements of regulatory agencies. While normal diesel fuel, with sulfur content typically greater than 500 ppm, offers some protection against metal wear, the low sulfur hydrotreated fuels now coming on the market with sulfur contents typically below 500 ppm and/or an aromatic content of less than 35 percent by weight, do not afford the same natural anti-wear lubricity protection. In general, however, the fuel and its inherent lubricity is expected to vary according to the severity of the regulatory requirements. For example, many low sulfur fuels have sulfur content less than 50 ppm and would be expected to have an inherent lubricity much less than that of a fuel having a sulfur content of 500 ppm.

As a result of the variance in inherent lubricities between fuels, the amount of the lubricity additive sufficient to improve the lubricity of the fuel compositions of this invention may vary from about 5 to about 5000 ppm by weight per weight of the fuel. Desirably, the concentration of the additive is about 50 to about 300 ppm by weight per weight of the fuel.

The present invention may also find application in the area of aviation fuels, such as those conventionally used in jet turbine engines. These fuels have a composition which is quite close to that of diesel fuels having low aromatic and low sulfur content. It is well within the contemplation of the present invention that the addition of the lubricity additives to the fuel compositions of this invention can improve lubricity and reduce engine wear with concentrations of the additive in the range of about 5 to about 5000 ppm by weight per weight of the fuel.

Regardless of the fuel used in this invention, the key aspect is the desire to improve the lubricity of the fuel. Therefore, fuels having some lubricity can be used as components of the fuel compositions of this invention, however, it is the fuels which have minimal lubricity or at the minimum accepted lubricity values or less that are desired for use in this invention.

The fuel compositions according to this invention may also include numerous other additives. Among these are flow improvers, waxy anti-settling additives, demulsifying agents, cloud point depressants, anti-static additives, anti-oxidants, biocides, odor masks, metal deactivators, anti-foams, detergents/dispersant additives, dyes, cetane improvers, as well as other lubricity additives.

The fuel oil compositions of the present invention may be produced by incorporation of either the additive alone or an additive composition wherein the additive composition may include other additive compounds including demulsifying agents, corrosion inhibitors, anti-oxidants, dyes, and the like, provided that they do not adversely affect the anti-wear effectiveness of the amino functional fatty acid oligomers used as lubricity additives for the fuel compositions of this invention and that the components of such mixtures are compatible.

Moreover, the additive or additive composition may be present as a liquid concentrate. The amount used of each of these compositions will be such as to insure the incorporation into the fuel of the requisite amount of the lubricity additive. For example, regardless of whether the additive is present in a concentrate composition, the amount of the active ingredient of the additive will be in the range of about 5 to about 5,000 ppm by weight per weight of the base fuel.

The present invention provides for a method of making an additive composition for enhancing the lubricity of a hydrocarbon fuel oil, where the method includes reacting (i) an alkylated polyamine and (ii) urea or isocyanate under conditions to form a compound of Formula I. In a further embodiment, the method includes reacting (i) an alkylated polyamine and (ii) urea or isocyanate under conditions to form a mixture of the compounds Formula I and Formula II. In yet another embodiment, (i) an alkylated polyamine and (ii) urea or isocyanate are reacted under conditions to form a mixture of the compounds of Formulae I, II, and III.

The present invention also provides for a process for improving the lubricity of a hydrocarbon fuel. This process includes the step of combining with the fuel a sufficient amount of one or more of the reaction products of (i) an alkylated polyamine and (ii) urea or isocyanate, or the salt adducts of these reaction products to improve the lubricity of the fuel. The lubricity additive may be combined in an amount of about 5 to about 5000 ppm, and desirably combined in an amount of about 50 to about 300 ppm.

Conventional blending equipment and techniques may be used in preparing the fuel compositions of the present invention. Blending is normally carried out at ambient temperature.

The present invention further provides for an internal combustion engine system wherein the engine system includes fuel oil compositions herein described which have improved lubricity due to the presence of one or more of the reaction products of (i) an alkylated polyamine and (ii) urea or isocyanate, or the salt adducts of these reaction products.

As will become readily apparent by the following examples, lubricity evaluation tests reveal that the inventive fuel compositions containing one or more of the reaction products of (i) an alkylated polyamine and (ii) urea or isocyanate, or the salt adducts of these reaction products out-perform fuel compositions containing many of the prior art lubricity additives in terms of improving the lubricity and reducing and/or inhibiting the amount of engine system wear.

EXAMPLES

Example 1

This example demonstrates that the present fuel compositions show superior lubricity properties to fuel compositions treated with prior art additive compounds conventionally used for improving lubricity in fuels.

The results of the present example indicate that both the additive composition that includes the reaction products of N-alkyldiaminopropane and urea (Inventive Composition 1) and the inventive additive composition including the salt adducts of these reaction products (Inventive Composition 2) improve the lubricity of a low sulfur diesel fuel when using the low frequency reciprocating rig (LFRR) test as the evaluator test for lubricity. The LFRR test is based on a modified version of ASTM D-6079. In this method, a test specimen of fuel is placed in a reservoir and adjusted to a temperature of approximately 65° C. A vibrator arm holding a non-rotating steel ball and loaded with a 200 g mass is lowered until it contacts a test disk completely submerged in the fuel. The ball is caused to rub against the disk with a 2 mm stroke at 20 Hz for 75 minutes. The amount of wear is then measured under magnification over a distance of millimeters by measuring the flat spot and grooved surface which typically is present on the ball due to wear. It is generally accepted that diesel fuels with LFRR test values of 460 $\mu$m or less have good lubricity, while those with values exceeding 610 $\mu$m have poor lubricity. A dose response with the inventive lubricity additive compositions was compared to two commercial benchmark materials (Compound A and Compound B). The dose response was conducted by an outside facility using LFRR in a sample of Canadian low sulfur diesel fuel, with the following results reported as Wear Scar Diameters (WSD) in Table 1 below, wherein a lower Wear Scar Diameter indicates greater efficacy. The base fuel had less than 0.05 weight percent sulfur and less than 37 weight percent in aromatics, with a kinematic viscosity at 100° F. of 2.1 centistokes.

TABLE 1

| Additive | 25 ppm | 37.5 ppm | 40 ppm | 45 ppm | 50 ppm | 55 ppm | 60 ppm |
|---|---|---|---|---|---|---|---|
| Compound B | | | | | 600 | | 586 |
| Compound A | 736 | 381 | | | 419 | | |
| Inventive Composition 1 | 708 | | 642 | 664 | 638 | 468 | 417 |
| Inventive Composition 2 | 714 | | 669 | 370 | 389 | | |

In Table 1, the doses in ppm for all compounds are reported as ppm by weight of the active ingredient per weight of the fuel. The results presented in Table 1 show that when Inventive Additive Composition 1 is added to the base fuel at 55 ppm and 60 ppm to produce an inventive fuel oil composition, the LFRR values are 468 and 417 $\mu$m, respectively, which are at or lower than the 460 $\mu$m conventionally accepted value for a diesel fuel having good lubricity characteristics. Furthermore, at 60 ppm of Inventive Composition 1, the lubricity of the base fuel is superior to a fuel composition containing 60 ppm of prior art Compound B.

The results in Table 1 also indicate that the lubricity of the base fuel can be further enhanced when the salt adducts of the reaction products of N-alkyldiaminopropane and urea are used (Inventive Composition 2). For example, the LFRR values obtained with 45 ppm and 50 ppm of the salt adduct were even lower than those obtained with higher amounts (i.e., 50–60 ppm by weight) of Inventive Composition 1. In addition, at 50 ppm Inventive Additive Composition 2 enhances the lubricity of the base fuel to a greater extent than 50 ppm of prior art Compounds B and A, which yielded LFRR values of 600 and 419 um, respectively.

Example 2

The present example demonstrates that the inventive additive compositions improve the lubricity of low sulfur hydrocarbon fuel oils. The example further demonstrates that particular ratios of compounds of Formulae I, II, and III improve the lubricity to a greater extent than other ratios, or the Duomeen-T starting material.

The reaction useful for preparing the additive compositions of the present invention proceeds from the starting materials, N-alkyldiaminopropane (Duomeen-T) and urea, through a set of intermediates corresponding to the compounds of Formulae I and II to the compound of Formula III as shown in Scheme 1 below:

Starting Materials→Compounds I and II→Compound III

The identities of each of the reaction products of Scheme 1 were determined by NMR spectroscopy on a 300 MHz Varian Unity Plus Spectrophotometer. Compound III in Scheme 1 is the thermodynamically favored product at high temperatures, whereas the intermediate Compounds I and II can be kinetically frozen by lowering the temperature before the reaction is complete. Given this situation, it was possible to take samples from the reaction at different time points to obtain compositions having various ratios of the starting materials and compounds in Scheme 1. In particular, within the two hours it took to complete the reaction of scheme 1, samples were removed at four different time points. These samples, referred to as S1, S2, S3 and S4, contained different relative amounts of the starting materials and compounds according to Formulae I, II and III as indicated below.

| | |
|---|---|
| S1 | approximately: 44% starting material, 37% Compound I, 19% Compound II, 0% Compound III. |
| S2 | approximately: 0% starting material, 42.5% Compound I, 19.5% Compound II, 38% Compound III. |
| S3 | approximately: 0% starting material, 20% Compound I, 8% Compound II, 72% Compound III. |
| S4 | nearly pure amount of Compound III. |

Each of these fractions S1–S4 were tested for their ability to improve the lubricity of a low sulfur diesel fuel by using the low frequency reciprocating rig (LFRR) test described in Example 1 above as the evaluator test for lubricity. In particular, each of these samples was evaluated at 100 ppm by weight of the active ingredient (S) per weight of the fuel. As described above, a lower Ware Scar Diameter (WSD) indicates greater efficacy.

TABLE 2

| Sample | WSD |
|---|---|
| Blank | 668 |
| Duomeen-T | 398 |
| S1 | 413 |
| S2 | 302 |
| S3 | 357 |
| S4 | 584 |

As indicated by the results in Table 2, each of samples S1–S4 improve the lubricity of the base fuel. Sample S2, which has the highest ratio of Compounds I and II to Compound III, but no starting material, has the greatest efficacy. Table 2 further indicates that the starting material Duomeen-T also provides lubricity protection. However, the efficacy of samples S2 and S3 is greater than that of Duomeen-T at 100 ppm. Whereas Table 2 does indicate that sample S4 improves the lubricity of the base fuel, the efficacy is less than that obtained with samples S1–S3 or the Duomeen-T starting material. However, there does appear to be an increase in the lubricity of the base fuel when fraction S4 is mixed with sample S2. This data is shown in Table 3 below, which shows the LFRR values reported as wear scar diameters obtained from mixing the samples S1–S4, in various ratios, with one another or the Duomeen-T (D-T) starting material. In particular, since sample S2 works more effectively by itself than does sample S4 by itself, this would imply that sample S4 is exhibiting synergy at both 25 and 50 weight percent levels. With further reference to Table 3below, it is noted that the opposite occurs when Duomeen-T is added to S2 in the same proportions.

TABLE 3

| S2 (ppm) | S4 (ppm) | WSD | S2 (ppm) | D-T (ppm) | WSD |
|---|---|---|---|---|---|
| 100 | 0 | 302 | 100 | 0 | 302 |
| 75 | 25 | 280 | 75 | 25 | 338 |
| 50 | 50 | 289 | 50 | 50 | 404 |
| 25 | 75 | 338 | 25 | 75 | 398 |
| 0 | 100 | 584 | 0 | 100 | 398 |
| **S4 (ppm)** | **D-T (ppm)** | **WSD** | **S3 (ppm)** | **D-T (ppm)** | **WSD** |
| 100 | 0 | 584 | 100 | 0 | 357 |
| 75 | 25 | 423 | 75 | 25 | 397 |
| 50 | 50 | 389 | 50 | 50 | 314 |
| 25 | 75 | — | 25 | 75 | 381 |
| 0 | 100 | 398 | 0 | 100 | 398 |

The results in Tables 2 and 3 further indicate that while the preferred additive composition has little or no starting material, it can be seen that the starting material Duomeen-T can improve the lubricity of a base HC fuel, either alone or in combination with samples S3 or S4, which each contain high amounts of the cyclic urea derivative having Formula III. For example, referring to Table 3, the results show that mixing sample S3 or sample S4 with Duomeen-T leads to an increase in lubricity at 50 weight percent levels.

In conclusion, the present example demonstrates that the addition of S4 at 25–50 weight percent levels enhances the efficacy of sample S2. This implies that the Compound of Formula III (cyclic urea derivative) synergizes with the components of sample S2 to improve the overall lubricity of the base fuel relative to sample S2 alone. We can further conclude from this example that for those samples having higher concentrations of Compound III (S3 and S4), addition of the starting material Duomeen-T at 50% weight percent levels improves the lubricity of the base fuel relative to either sample S3 or S4 alone. Moreover, the addition of Duomeen-T at any weight percent level does not appear to improve the lubricity of sample S2, which has a higher ratio of (Compounds I and II) to Compound III than does S3 or S4.

Finally, we conclude that particular ratios of compounds according to Formulae I, II, and III provide greater efficacy than other ratios of these compounds, or the starting material. The sample including the highest ratio of (Compounds I and II) to Compound III, but no starting material (sample S2), provides a preferred embodiment of the additive composition of the present invention.

What is claimed is:

1. A hydrocarbon fuel oil composition comprising:

(a) a hydrocarbon fuel oil; and (b) a lubricity additive, wherein said additive comprises a predominant amount of a mixture of the compounds of Formulae I and II, or the salt adducts of said mixture:

Formula I

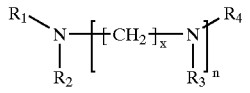

Formula II

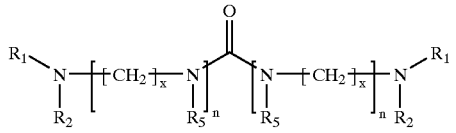

wherein $R_1$ is a hydrocarbyl group from $C_{8-30}$; $R_2$ is each independently hydrogen, a hydrocarbyl group from $C_{8-30}$, or the group Y; $R_3$ is each independently hydrogen, a hydrocarbyl group from $C_{8-30}$, or $(CH_2)_qOH$; $R_4$ is hydrogen, a hydrocarbyl group from $C_{8-30}$, $(CH_2)_qOH$, or the group Y; $R_5$ is each independently hydrogen, a hydrocarbyl group from $C_{8-30}$, or $(CH_2)_qOH$; x is from 2–6 and n is from 1 to 6, or mixtures thereof; q is from 1 to 6; and Y is as follows wherein $R_3$ is as defined above:

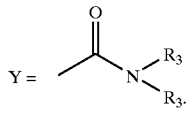

2. The composition of claim 1, wherein said additive mixture further comprises a compound of Formula III, or a salt adduct thereof:

Formula III

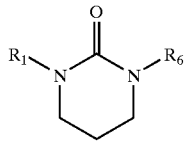

wherein $R_1$ is a hydrocarbyl group from $C_{8-30}$; and $R_6$ is hydrogen, or a hydrocarbyl group from $C_{8-30}$.

3. The composition of claim 2, wherein the ratio of the compound of Formula I to the compound of Formula II in said mixture is about 1:1 to about 4:1.

4. The composition of claim 3, wherein the ratio of the compound of Formula I to the compound of Formula II in said mixture is about 1.5:1 to about 2.5:1.

5. The composition of claim 2, wherein the ratio of the compound of Formula III to the combined mixture of compounds of Formulae I and II is about 0:1 to about 2.5:1.

6. The composition of claim 1, wherein said hydrocarbon fuel oil contains less than 0.2% by weight of sulfur, based on the weight of said fuel oil.

7. The composition of claim 1, wherein said additive is present in a liquid carrier compatible with said hydrocarbon fuel oil.

8. The composition of claim 1, wherein said additive is present in said fuel oil composition in an amount of about 5 to about 5000 ppm by eight per weight of said hydrocarbon fuel oil.

9. The composition of claim 8, wherein said additive is present in an amount of about 50 to about 300 ppm by weight per weight of said hydrocarbon fuel oil.

10. The composition of claim 2, wherein said lubricity additive comprises the salt adducts of one or more of said compounds of Formula I, Formula II or Formula III.

11. The composition of claim 10, wherein said salt adducts are formed from the reaction between a low molecular weight carboxylic acid and one or more of said compounds of Formula I, Formula II or Formula III.

12. The composition of claim 11, wherein said carboxylic acid is propionic acid.

13. The composition of claim 1, wherein said hydrocarbon fuel oil is a diesel fuel.

14. The hydrocarbon fuel oil composition of claim 1, wherein the hydrocarbon fuel oil has a sulfur content of about 0.01 to about 0.5% by eight per weight of said hydrocarbon fuel.

15. The composition of claim 1, wherein said additive is present in said composition in an amount of about 50 to about 300 ppm by weight per weight of said hydrocarbon fuel oil.

16. A hydrocarbon fuel oil composition comprising:

(a) a hydrocarbon fuel oil; and (b) at least one open chain urea derivative formed from an alkylene polyamine, said open chain urea derivative comprising a compound of the following formula, or a salt adduct thereof:

Formula I

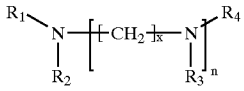

wherein $R_1$ is a hydrocarbyl group from $C_{8-30}$; $R_2$ is hydrogen, a hydrocarbyl group from $C_{8-30}$, or the group Y; $R_3$ is each independently hydrogen, a hydrocarbyl group from $C_{8-30}$, or $(CH_2)_qOH$; $R_4$ is hydrogen, a hydrocarbyl group from $C_{8-30}$, $(CH_2)_qOH$, or the group Y; x is from 2–6 and n is from 1 to 6, or mixtures thereof; q is from 1 to 6; and Y is as follows wherein $R_3$ is as defined above:

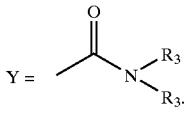

17. The composition of claim 16, wherein the alkylene polyamine is N-alkyldiaminopropane.

18. A hydrocarbon fuel oil composition comprising:

(a) a hydrocarbon fuel oil; and (b) at least one open chain urea derivative formed from an alkylene polyamine, said open chain urea derivative comprising a compound of the following formula, or a salt adduct thereof:

Formula II

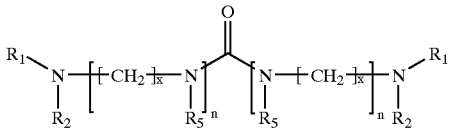

wherein $R_1$ is a hydrocarbyl group from $C_{8-30}$; $R_2$ is each independently hydrogen, a hydrocarbyl group from $C_{8-30}$, or the group Y; $R_3$ is each independently hydrogen, a hydrocarbyl group from or $(CH_2)_qOH$; $R_5$ is each independently hydrogen, a hydrocarbyl group from $C_{8-30}$, or $(CH_2)_qOH$; x is from 2–6 and n is from 1 to 6, or mixtures thereof; q is from 1 to 6 and Y is as follows wherein $R_3$ is as defined above:

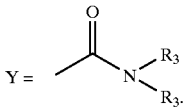

19. A hydrocarbon fuel oil composition comprising:

(a) a hydrocarbon fuel oil; and (b) at least one cyclic urea derivative formed from an alkylene polyamine, said cyclic urea derivative comprising a compound of the following formula, or a salt adduct thereof:

Formula III

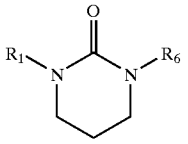

wherein $R_1$ is a hydrocarbyl group from $C_{8-30}$; and $R_6$ is hydrogen, or a hydrocarbyl group from $C_{8-30}$.

20. The composition of claim 16, wherein said hydrocarbon fuel oil contains less than 0.2% by weight of sulfur, based on the weight of said fuel oil.

21. The composition of claim 16, wherein said open chain urea derivative is present in an amount of about 50 to about 300 ppm by weight per weight of said hydrocarbon fuel oil.

22. The composition of claim 16, wherein said hydrocarbon fuel oil is a diesel fuel.

23. An internal combustion engine system, wherein the system includes the fuel oil composition of claim 1.

24. An additive composition for increasing the lubricity of a hydrocarbon fuel oil comprising a predominant amount of mixture of the compounds of Formulae I and II, or the salt adducts of said mixture:

Formula I

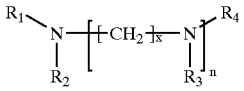

Formula II

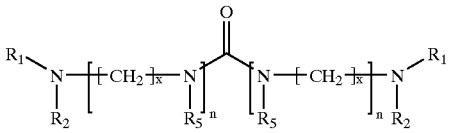

wherein $R_1$ is a hydrocarbyl group from $C_{8-30}$; $R_2$ is each independently hydrogen, a hydrocarbyl group from $C_{8-30}$, or the group Y; $R_3$ is each independently hydrogen, a hydrocarbyl group from $C_{8-30}$, or $(CH_2)_qOH$; $R_4$ is hydrogen, a hydrocarbyl group from $C_{8-30}$, or $(CH_2)_qOH$, or the group Y; $R_5$ is each independently hydrogen, a hydrocarbyl group from $C_{8-30}$, or $(CH_2)_qOH$; x is from 2–6 and n is from 1 to 6, or mixtures thereof, q is from 1 to 6 and Y is as follows wherein $R_3$ is as defined above:

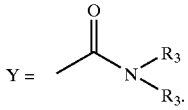

25. The additive composition of claim 24, further comprising a compound of Formula III, or a salt adduct thereof:

Formula III

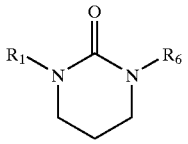

wherein $R_1$ is a hydrocarbyl group from $C_{8-30}$; and $R_6$ is hydrogen, or a hydrocarbyl group from $C_{8-30}$.

26. A method of making an additive composition for enhancing the lubricity of a hydrocarbon fuel oil comprising reacting (i) an alkylated polyamine and (ii) urea or an isocyanate compound under conditions to form a compound of Formula I and a compound of Formula II:

Formula I

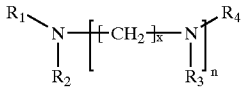

Formula II

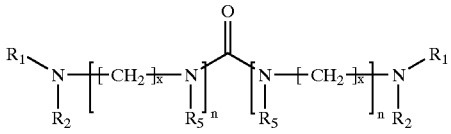

wherein $R_1$ is a hydrocarbyl group from $C_{8-30}$; $R_2$ is each independently hydrogen, a hydrocarbyl group from $C_{8-30}$, or the group Y; $R_3$ is each independently hydrogen, a hydrocarbyl group from $C_{8-30}$, or $(CH_2)_qOH$; $R_4$ is hydrogen, a hydrocarbyl group from $C_{8-30}$, $(CH_2)_qOH$ or the group Y; $R_5$ is each independently hydrogen, a hydrocarbyl group from $C_{8-30}$, or $(CH_2)_qOH$; x is from 2–6 and n is from 1 to 6, or mixtures thereof; q is from 1 to 6 and Y is as follows wherein $R_3$ is as defined above:

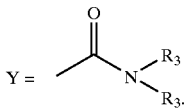

27. The method of claim 26, wherein components (i) and (ii) are reacted under conditions to additionally form a compound of Formula III:

Formula III

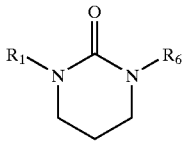

wherein $R_1$ is a hydrocarbyl group from $C_{8-30}$; and $R_6$ is hydrogen, or a hydrocarbyl group from $C_{8-30}$.

28. A process for improving the lubricity of a hydrocarbon fuel oil comprising combining said fuel oil with a sufficient amount of the additive composition of claim 24.

29. The process of claim 28, wherein said additive composition is combined in an amount of about 5 to about 5000 ppm by weight per weight of said fuel oil.

30. The process of claim 28, wherein said additive composition is combined in an amount of about 50 to about 300 ppm by weight per weight of said fuel oil.

31. The composition of claim 16, wherein said open chain urea derivative is present in an amount of about 5 to about 5000 ppm by weight per weight of said hydrocarbon fuel.

32. The composition of claim 18, wherein said hydrocarbon fuel contains less than 0.2% by weight of sulfur, based on the weight of said fuel oil.

33. The composition of claim 18, wherein said open chain urea derivative is present in an amount of about 5 to about 5000 ppm by weight per weight of said hydrocarbon fuel oil.

34. The composition of claim 18, wherein said open chain urea derivative is present in an amount of about 50 to about 300 ppm by weight per weight of said hydrocarbon fuel.

35. The composition of claim 18, wherein said hydrocarbon fuel oil is a diesel fuel.

36. The composition of claim 19, wherein said hydrocarbon fuel contains less than 0.2% by weight of sulfur, based on the weight of said fuel oil.

37. The composition of claim 19, wherein said cyclic urea derivative is present in an amount of about 5 to about 5000 ppm by weight per weight of said hydrocarbon fuel oil.

38. The composition of claim 19, wherein said cyclic urea derivative is present in an amount of about 50 to about 300 ppm by weight per weight of said hydrocarbon fuel oil.

39. The composition of claim 19, wherein said hydrocarbon fuel oil is a diesel fuel.

* * * * *

UNITED STATES PATENT AND TRADEMARK OFFICE

CERTIFICATE OF CORRECTION

PATENT NO. : 6,872,230 B2
DATED : March 29, 2005
INVENTOR(S) : Cross et al.

It is certified that error appears in the above-identified patent and that said Letters Patent is hereby corrected as shown below:

Column 8,
Line 67, should read -- values of 600 and 419 $\mu$m respectively. --.

Column 10,
Lines 12-13, should read -- Table 3 below… --.

Column 11,
Line 60, should read -- ...by weight per weight of said… --.

Column 12,
Line 11, should read -- ...by weight per weight of said… --.

Signed and Sealed this

Seventh Day of June, 2005

JON W. DUDAS
*Director of the United States Patent and Trademark Office*